United States Patent [19]

Mariani

[11] Patent Number: 4,917,446

[45] Date of Patent: Apr. 17, 1990

[54] SYSTEM FOR MOVING THE DOOR OF A CABINET FROM AN OPEN TO A CLOSED POSITION

[75] Inventor: Roberto Mariani, Cesano Maderno, Italy

[73] Assignee: Ditta Mariani Enrico, Desio, Italy

[21] Appl. No.: 329,164

[22] Filed: Mar. 27, 1989

[30] Foreign Application Priority Data

Mar. 29, 1988 [IT] Italy ..... 20012 A/88

[51] Int. Cl.[4] ..... A47B 48/00

[52] U.S. Cl. ..... 312/325; 49/246; 49/253

[58] Field of Search ..... 49/246, 248, 253; 312/326, 266, 325, 326, 327, 328, 329

[56] References Cited

U.S. PATENT DOCUMENTS

| | | | |
|---|---|---|---|
| 2,161,323 | 6/1937 | Stephenson | 312/266 |
| 2,919,966 | 1/1960 | Preston | 312/266 X |
| 3,175,761 | 3/1965 | Moore | 49/246 X |
| 3,315,412 | 4/1967 | Hultgren | 49/246 |
| 4,393,623 | 7/1982 | Munz | 49/253 |

*Primary Examiner*— Falk

*Attorney, Agent, or Firm*—Griffin, Branigan & Butler

[57] ABSTRACT

The door is connected to the fixed frame of a cabinet by means of two elbow-shaped horizontal arms each of which is constituted by two branches, by an elbow and by two extremities rotatable round respective pivots. The ratio between the length of the second branch and that of the first branch is greater than 1 and the ratio between the length of said first branch and the distance (A) between said pivot and the closest point of the door in the closed position is equal to or greater than 1.

In the displacement of the door, the two elbow-shaped horizontal arms co-operate with a guide whereby the door is maintained substantially parallel to the fixed frame.

5 Claims, 8 Drawing Sheets

SYSTEM FOR MOVING THE DOOR OF A CABINET FROM AN OPEN TO A CLOSED POSITION

BACKGROUND OF THE INVENTION

Field of the Invention

The present invention refers to a system for moving the door of a cabinet from an open to a closed position.

In known systems with a sliding door, the door is equipped with slides whereby it can slide along guides which are integral with the cabinet. A first drawback which is common to all these systems is that their assembly requires considerable skill and time. A second drawback consists in their noisiness. A third drawback is that it is almost impossible to distribute the weight of the door uniformly on the top and on the bottom guide because, in everyday use, it is not possible to maintain the base of the cabinet in a perfectly horizontal plane. Thus the entire weight of the door will bear either on the upper slide only or on the lower slide only so that not only does it constitute a guiding organ, it also functions as a supporting organ, while the other slide acts merely as a guiding organ.

In the case of fairly large cabinets, the door can be of considerable weight and this causes a substantial wear on the sliding organs (guides and bearings) with consequent failures and jamming.

An additional drawback in doors sliding on guides consists in the fact that they do not provide an effective closing system due to the space which must necessarily be left between one door and the other which slides on a guide that is parallel to the one on which the first slides and which is superimposed on it in the closed position. An attempt has been made to overcome this drawback using supplementary means whereby it is possible for the door to move perpendicularly to the guide so that the doors can move with respect to one another along both Cartesian axes.

Obviously, these supplementary means increase substantially the cost of the system and are themselves subject to frequent failures. In addition, since the door must be pushed in a direction that is perpendicular to the guide, the hands are always placed in the same position and thus, in time, stains will appear on the surface of the door.

In its turn, FR-A-2551795 describes a system for moving a door of a cabinet which is essentially constituted by two bracket-shaped horizontal arms in which the two orthogonal branches which form each bracket have the same length and said length is substantially equal to one half of the width of the door to which the two arms are connected. It is evident that for each pair of said arms the cabinet shall have to be constructed exactly since the difference of even one centimetre more or less in the width of the door shall cause serious malfunctions in the door moving system.

The need therefore is still keenly felt for a system for moving a door whereby the vertical edge of the door next to the first vertical upright when said door is open is then next to the second vertical upright when said door is closed, for said system not to be too complicated and thus be fairly inexpensive and not subject to frequent failures while, at the same time, ensuring an effective closing action when the door is closed even when the width of the cabinet, and thus of the door, is different by some centimeters from that planned.

The object of the present invention is the accomplishment of a system which satisfies the above need.

SUMMARY

This has been obtained by means of a system for moving a door of a cabinet from a closed to an open position, said cabinet comprising at least one door and one fixed frame constituted by at least one first and one second vertical upright as well as by at least one upper and one lower horizontal shelf, in which said door can be moved in relation to said fixed frame so that the vertical edge of the door next to said first vertical upright when said door is open will then be next to said second vertical upright when said door is closed, said door being moreover connected to said fixed frame by means of two elbow-shaped horizontal arms, each of which is constituted by two branches, by an elbow and by two extremities rotatable round respective pivots, and being the first extremity of one and the other elbow-shaped horizontal arms mounted rotatably on the upper and lower part, respectively, of said fixed frame while the second extremity of one and the other elbow-shaped horizontal arms is mounted rotatably on said door on an upper and a lower point, respectively, arranged on the vertical line which passes through the centre of gravity of said door, characterized in that in each elbow-shaped horizontal arm the second branch, which lies between said second extremity and the elbow, is longer than the first branch, which lies between said elbow and said first extremity, that the length of said first branch of each elbow-shaped horizontal arm is equal to or greater than the distance between the pivot around which rotates said first extremity of each elbow-shaped horizontal arm and the closest point of the door in the closed position and that said elbow-shaped horizontal arms co-operate with a guide which maintains the door substantially parallel to the fixed frame.

Thanks to this peculiar construction, the horizontal arm according to the present invention can move doors having a width which differs by some centimeters from that planned. As a matter of fact, the said first extremity can be fitted in different positions on the fixed frame provided that the distance between the pivot on which rotates said first extremity and the closest point of the door in the closed position is not greater than the length of the first branch of the arm itself.

This is necessary to guarantee that the second branch of the arm, from the elbow to the door, can be aligned parallel to the cabinet when the door is open.

To this purpose, the first rotatable extremity of the arms is preferably mounted either on the upper or on the lower extremity, respectively, of the first vertical upright or above said upper or below said lower horizontal shelf, respectively, but very close to said first vertical upright.

When the angle of the elbow is fixed, this is preferably of 90°. Said arms can, however, also be made so that the angle of the elbow is of variable amplitude. This may be obtained, for example, by having a pivot or a bearing between the two branches of the arm. This type of construction has the advantage that the branch of the arm between the elbow and the door can be even longer than it can be when angle of the elbow is 90°. In this variation the angle of the elbow is acute when the door is closed and is 90° when the door is completely open; in this position the further greater length of the second branch of the arm allows for a greater displacement of the door in relation to the second vertical upright so that the entire inner part of the cabinet can be reached even more easily.

In the system according to the present invention, the ratio between the length of the second branch of the horizontal arm and the distance from the pivot of the second rotatable extremity of said horizontal arm to the edge of said door which is next to said second vertical upright in the closed position, is equal to or greater than 0.70.

This means that when said ratio is equal to 0.70 the open door does not take up more than 15% of the cabinet's access opening.

Even more preferably said ratio has a value between 1 and 1.10, so that the cabinet's access opening is wholly accessible. This result can be attained, in addition to the case with the articulated joint as described above, in several other ways. For example, by having the second branch of the arm between the elbow and the door to telescope along its axis or by moving the centre of gravity of the door towards the second upright.

In the system according to the present invention, both horizontal arms support the weight of the door, so that the weight is uniformly distributed on them. In addition, the fact that the connecting points of the two horizontal arms are arranged on the vertical line which passes through the centre of gravity of said door makes for such balancing of the system which cannot, on the other hand, be obtained in the case of the well-known system constituted by slides and bearings. Another feature of the system according to the present invention is that it is almost entirely exempt from failures since its movement is ensured by two pairs of simple pivots.

The system consisting of two elbow-shaped horizontal arms described above and illustrated in the enclosed drawings is in itself sufficient in overcoming the drawbacks of the systems known up to the present time. Said elbow-shaped horizontal arm thus constitutes the essential feature of the present invention.

On the other hand, since the door is mounted rotatably on the second extremity of two elbow-shaped horizontal arms arranged one perpendicular to the other, the operator must grasp both the vertical sides of the door if it is to be maintained substantially parallel to the fixed frame during the opening and closing movements.

If we wish to enable the user to open and close the door with one hand only, it will be preferable to combine the system according to the present invention with guide whereby the door is maintained substantially parallel to the fixed frame during the opening and closing operations.

A type of guide with a rigid bar suitable for the purpose is described below and is illustrated in the enclosed drawings. Many variations or alternatives may be made to said guide without, however, impairing the required function of permitting the user to open and close the door with one hand only.

Another preferred feature of the embodiment shown in the enclosed drawings is the device whereby the door hooks the cabinet. Also in this case, several variations or alternatives are possible without departing from the inventive idea outlined in the present description.

BRIEF DESCRIPTION OF THE DRAWINGS

These and other features will appear self-evident, to an artisan, both from the description and from the enclosed drawings which, as a non-limiting example, illustrate an embodiment according to the present invention and in which.

DETAILED DESCRIPTION OF THE DRAWINGS

Figure 1:
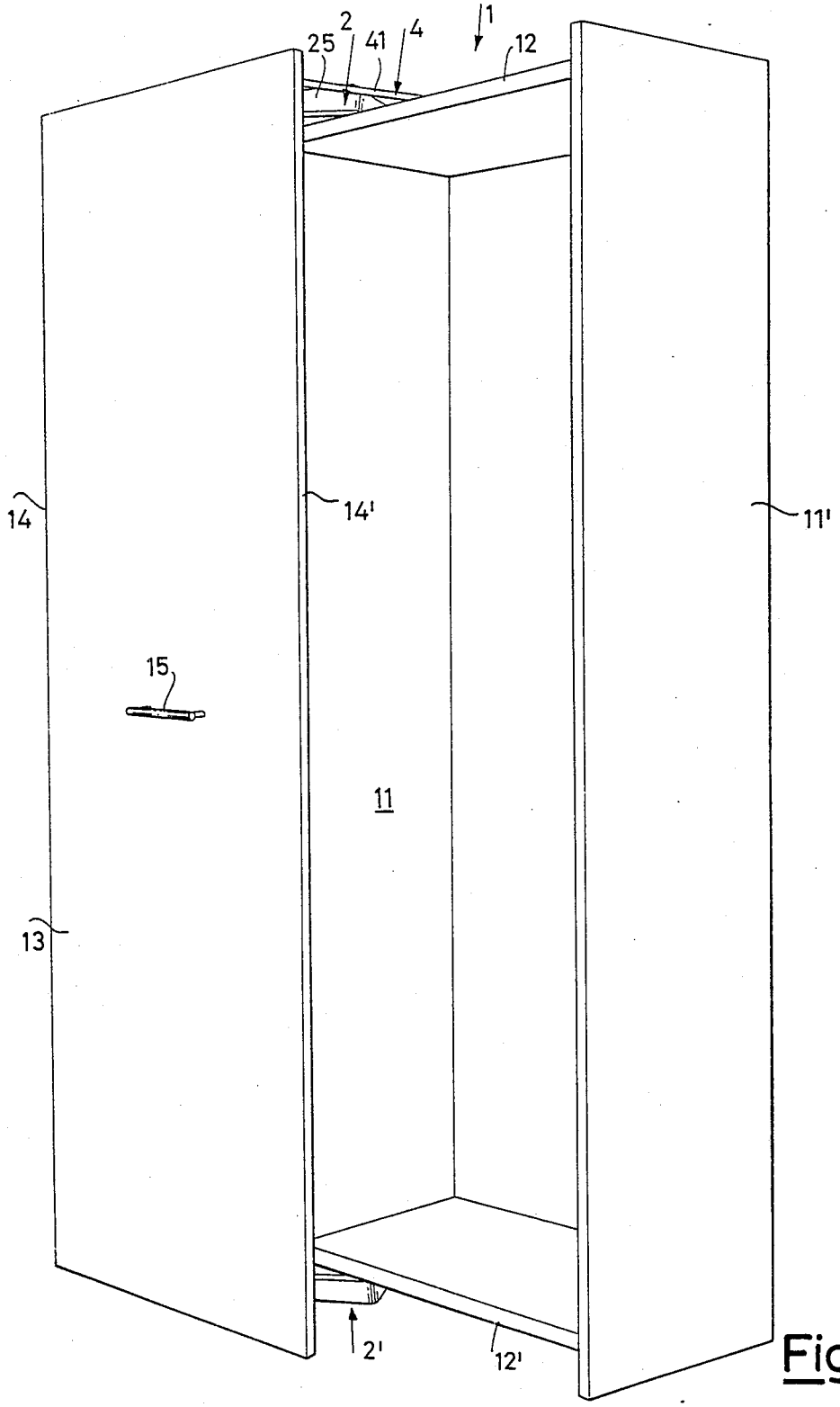
FIG. 1 is a perspective representation of a cabinet whose door may be moved by means of a system according to the present invention.

As can be seen from FIG. 1, in a cabinet 1, comprising a fixed frame consisting of a first vertical upright 11, a second vertical upright 11′, an upper horizontal shelf 12 and a lower horizontal shelf 12′, a door 13 equipped with a handle 15 is mounted in a movable way, with respect to said fixed frame, so that the part 14′ of the door 13 which is next to said first vertical upright 11 is subsequently next to said second vertical upright 11′ when the door 13 is closed.

Said door 13 is connected to said fixed frame by means of two elbow-shaped horizontal arms 2 and 2′ mounted above and below, respectively, said shelves 12 and 12′. Lastly, FIG. 1 also shows part of the rigid bar of the guide 4 whereby the door 13 can be kept in a position that is substantially parallel to the fixed frame during the closing opening operations.

Figure 2:
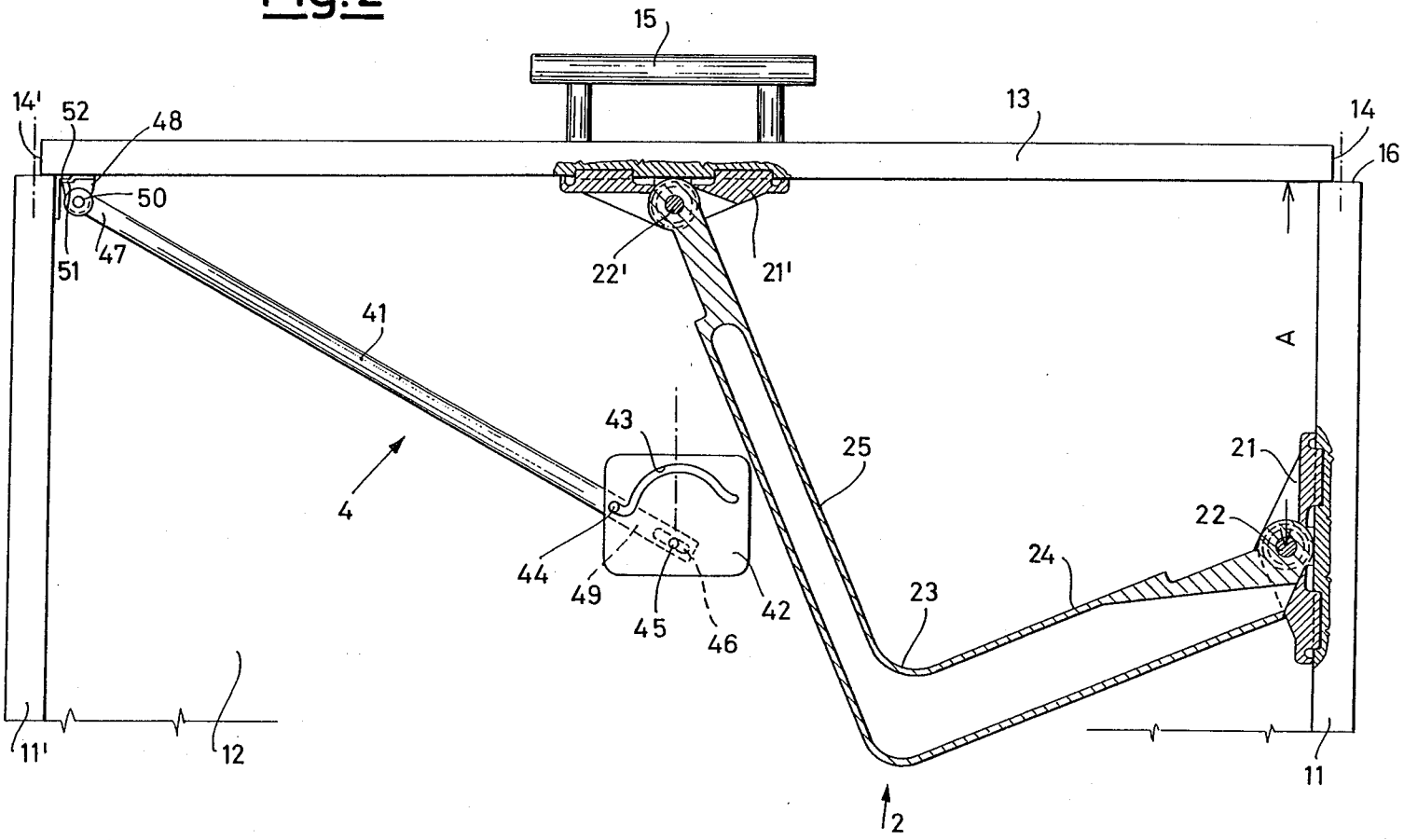
FIG. 2 is a view from above of the cabinet of FIG. 1 except that the door is closed.

FIG. 2 shows the position of the elbow-shaped horizontal arm 2, in cross-section, of the guide 4 and of the connecting device 51 and 52, when the door 13 is closed. It is thus seen that the elbow-shaped horizontal arm 2 according to the present invention is constituted by two branches 24 and 25, by an elbow 23 and by two extremities 21 and 21′, equipped with radial ball bearings, rotatable on their respective pivots 22 and 22′. The branch 25 is longer than the branch 24, i.e. their ratio is greater than 1. The rotating extremity 21 is, by screws or other suitable fastening means, integral with the vertical upright 11 while the rotatable extremity 21′, is, by screws or other suitable fastening means, integral with the door 13. The position and the conformation of the elbow-shaped horiziontal arm 2′ under the shelf 12′ has not been illustrated as it is substantially identical with that of arm 2.

In this embodiment, the centre of gravity of the door 13 is on the centre line of the door itself. The rotatable extremity 21′ and the corresponding rotatable extremity of the elbow-shaped horizontal arm 2′ (not illustrated) are thus mounted on said centre line.

As can be seen from FIGS. 2–6, the distance between the pivot 22, on which the first rotatable extremity 21 rotates, and the elbow 23 (i.e. the length of the first branch 24) is greater than the distance A between said pivot 22 and the closest point of the door 13 in the closed position (FIG. 2), i.e. their ratio is greater than 1. Said branch 24 will therefore protrude, in the open position (FIG. 6), beyond the fixed frame so that the second branch 25 can line up with the fixed frame. If the door 13 were to be wider than that illustrated, the extremity 21 would be mounted in a position closer to the edge 16 of the upright 11. In which case the distance A would be shorter than that illustrated in FIGS. 2–6.

Figure 6:
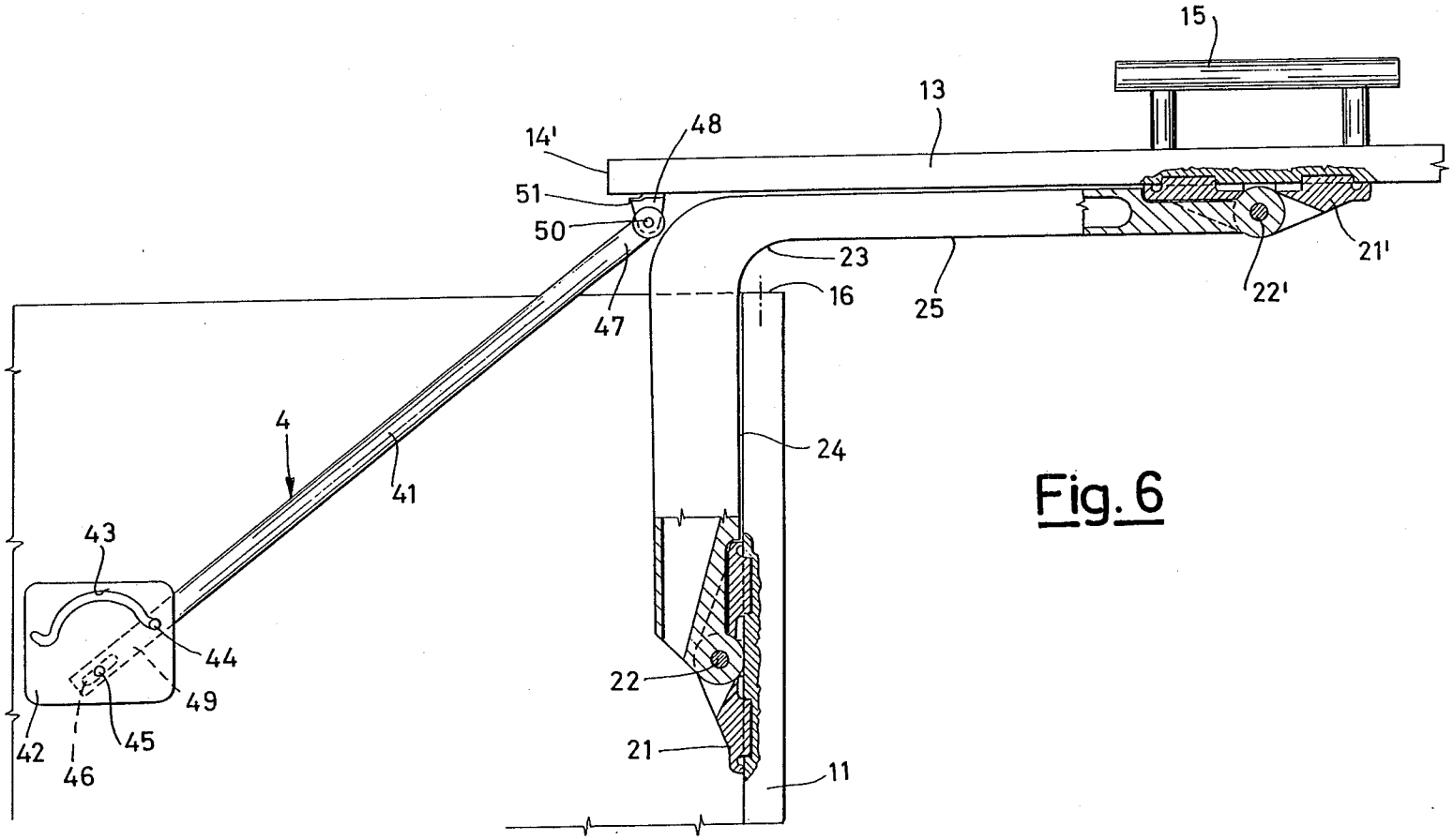

In the arm illustrated in FIGS. 2–6, the ratio between the distance from the elbow 23 to the pivot 22' of the second extremity of the elbow-shaped horizontal arm (i.e. the length of the second branch 25) and the distance from said pivot 22' to the vertical edge 14' of said door which is next to said second upright 11' in the closed position is about 0.8. This means that about 10% of the cabinet's access opening is still taken up by the door 13 in the open position (FIG. 6).

Figure 9:
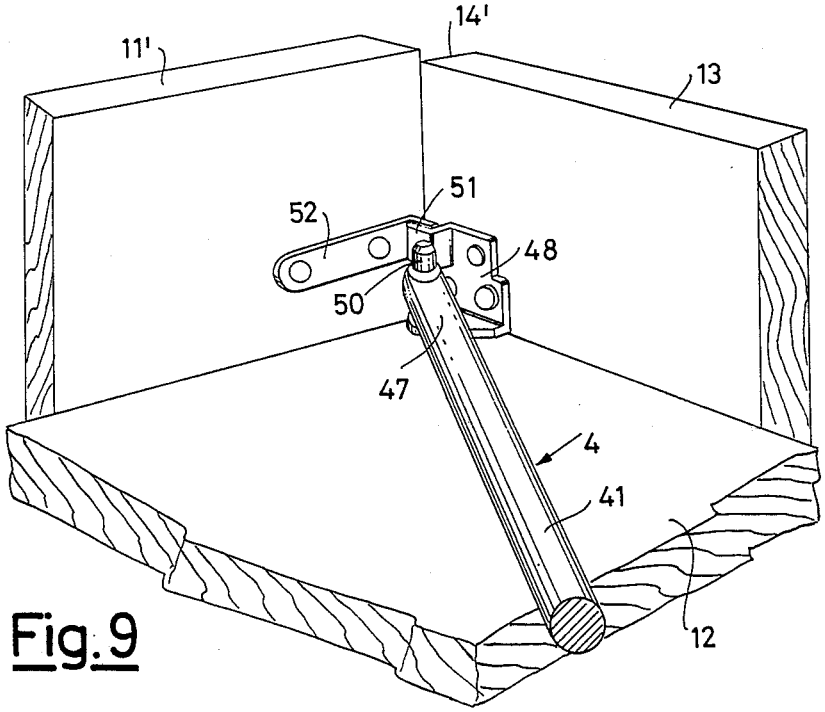
FIGS. 9 and 10 are a perspective and enlarged, with respect to FIGS. 2 and 3, representations of the connecting device between the door and the cabinet's fixed frame.

FIGS. 2–6 also illustrate the structure and the function of the guide 4. Said guide is essentially constituted by a housing 42 and by a rigid bar 41 one of whose extremities 47 is connected in a rotatable way to the door 13 while the other extremity 49 is connected to the housing 42 by means of a first pin 44 which is integral with said rigid bar 41 and by means of a second pin 45 which is integral with said housing 42; in addition, said housing 42 has a slit 43 in which said first pin 44 is obliged to move thus determining the displacement of said rigid bar 41 and thus of the door 13, in relation to said second pin 45. The upper plate of the housing 42 is connected to another base plate (not illustrated) which, in turn, is fastened to the shelf 12 by screws or other suitable fastening means. The two plates are held at a certain distance from one another by suitable means (not illustrated) arranged in any suitable position whatever which does not interfere with the movement of said rigid bar 41. The extremity 49 of the rigid bar 41 is equipped with a slot 46 and is mounted in a rotatable and slidable way in relation to the second pin 45 before the upper plate 45 of the housing 42 is made integral with the base plate (not illustrated). The rigid bar 41 is also equipped with a pin 44 which, during the assembly operations of the guide 4, is inserted in the slit 43 which defines its path. Lastly, the first extremity 47 of the rigid bar 41 is connected in a rotatable way to a pin 50 which is integral with a support 48 fastened to the door by screws or other suitable fastening means and said support 48 is integral with a bracket 51 which, during the closing phase, is superimposed on a small plate 52 fastened to the second vertical upright 11' of the fixed frame thus causing the connection of said door to said fixed frame (FIGS. 2 and 9).

Figure 3:
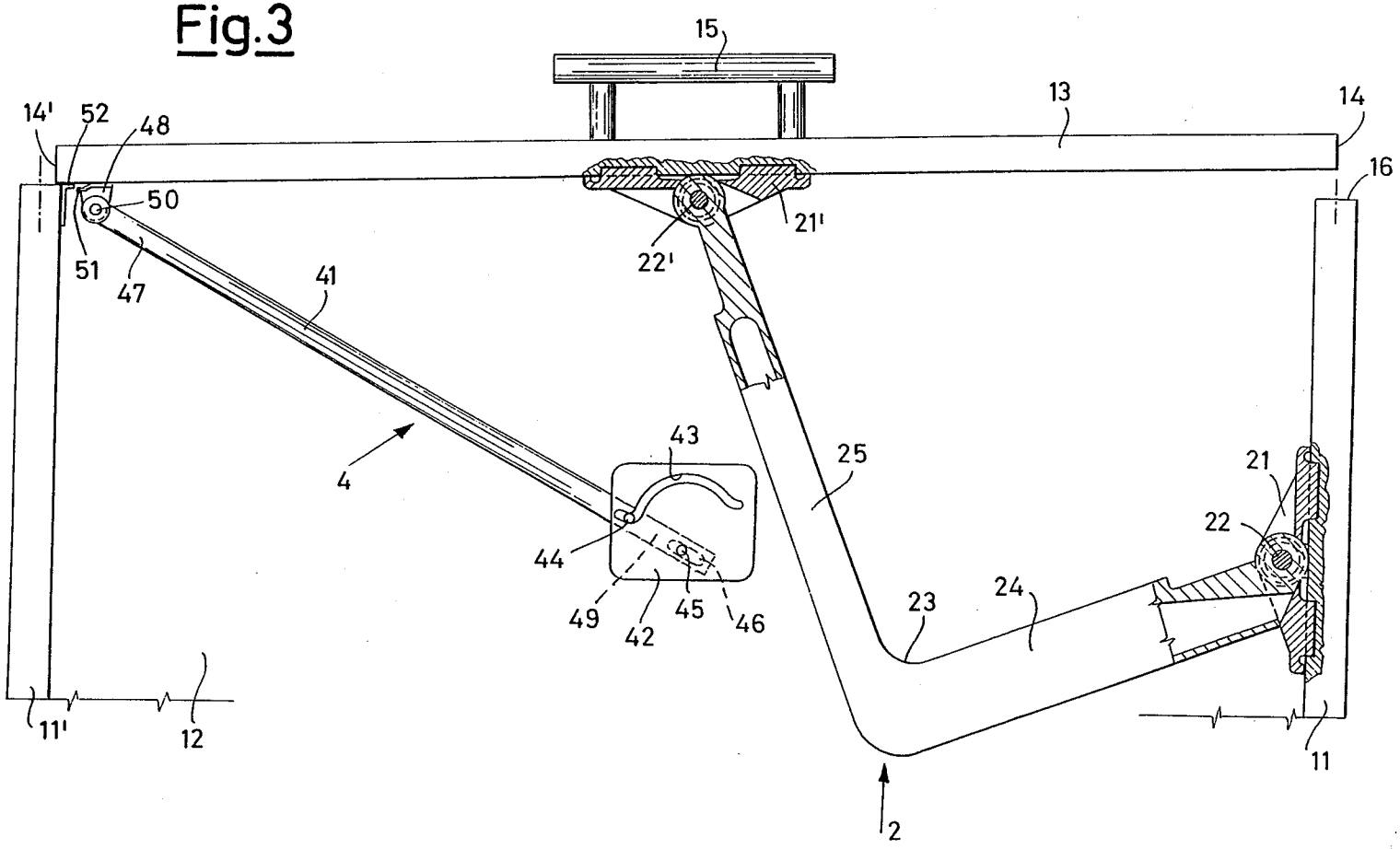
FIGS. 3, 4, 5 and 6 correspond to FIG. 2, except that they illustrate the more significant positions of the system according to the present invention during the door opening phase.
Figure 4:
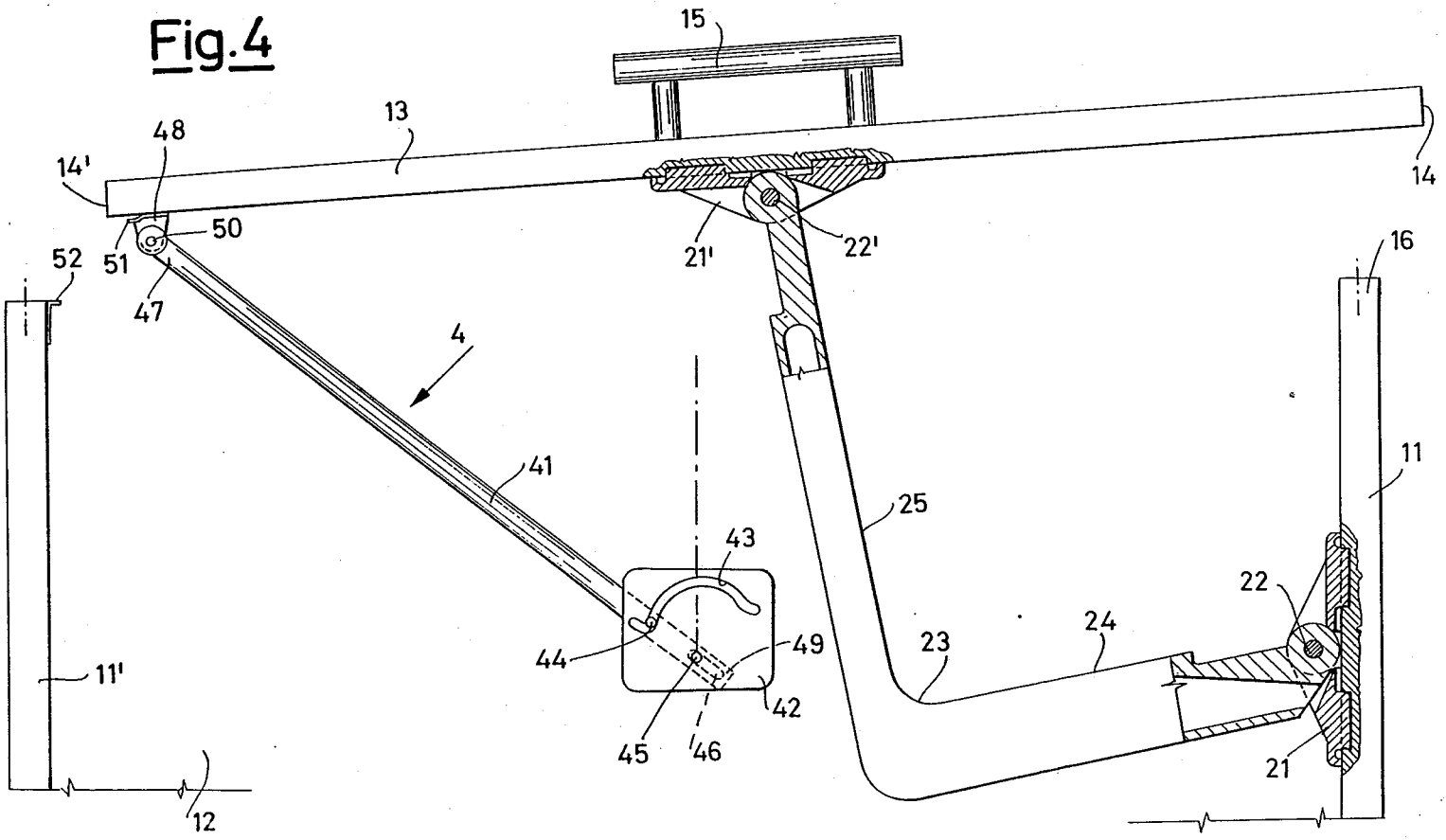
Figure 5:
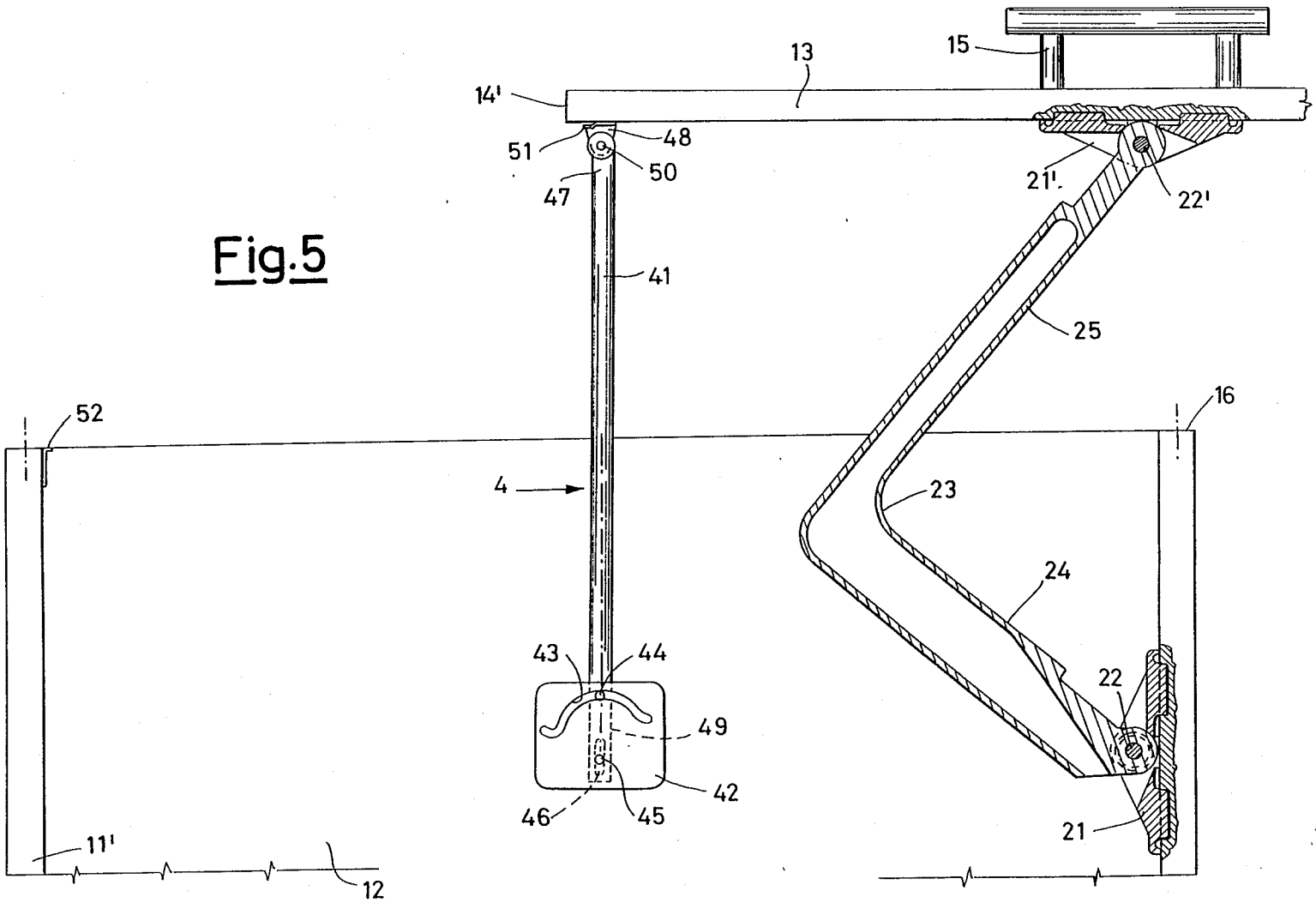

In addition to acting as a connecting device, the bracket 51 and the small plate 52 have a very important role during the opening phase as well. When the handle 15 is pulled towards the outside, the small plate 52 exerts a certain braking action on the bracket 51 and the vertical edge 14 of the door 13 thus moves away from the vertical upright 11 before the edge 14' moves away from the vertical upright 11' (FIG. 3). This allows the door 13 to overlap any adjacent door in a cabinet with more than one door and to superimpose itself on the same.

Figure 7:
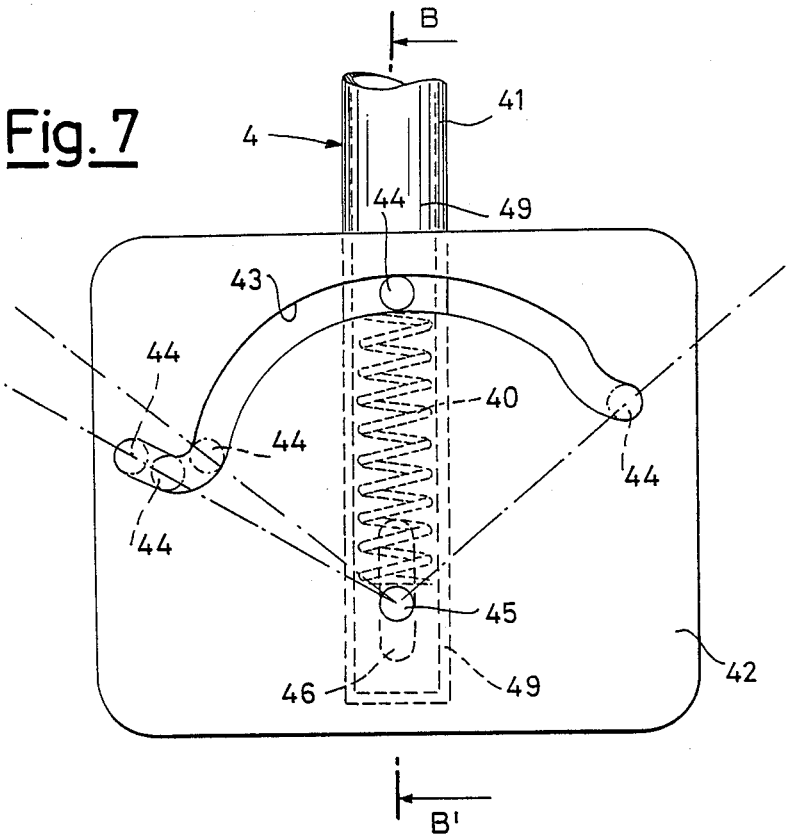
FIG. 7 is an enlarged view of the rigid bar guide assembly which co-operates with the elbow-shaped horizontal arms to maintain the door substantially parallel to the fixed frame during the closing and opening operations.

FIG. 7, enlarged with respect to FIGS. 2–6, illustrates the housing 42 of the guide 4 with the rigid bar 41. It can be seen from said figure that inside the terminal part 49 of the rigid bar 41, there is a spring 40 mounted compressed between the pins 44 and 45. Said spring tends to move the pin 44 away from the pin 45 and this is particularly important in the closed position (FIGS. 2 and 9) because the action of the spring 40 determines the superimposition of the bracket 51 on the small plate 52 and the subsequent blocking of the door 13. In addition, the pressure exerted on the door 13 by the rigid bar 41 forces the edge 14 to come close to the edge 16 of the upright 11 of the frame so that the cabinet is properly closed.

Figure 8:
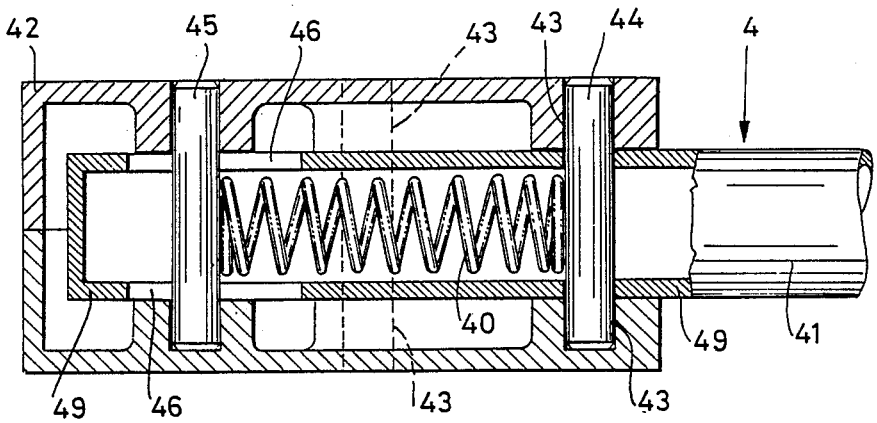
FIG. 8 represents a cross-section, along the axis B–B′ of FIG. 7, of the terminal part of the rigid bar.

FIG. 8 shows a cross-section of the housing 41 and of the terminal part 49 of the rigid bar 41 along the axis B–B' of FIG. 7 and illustrates its construction details. It can thus be seen that said terminal part 49 is mounted in a rotatable and slidable way, thanks to the slot 46, in relation to the pin 45.

Figure 10:
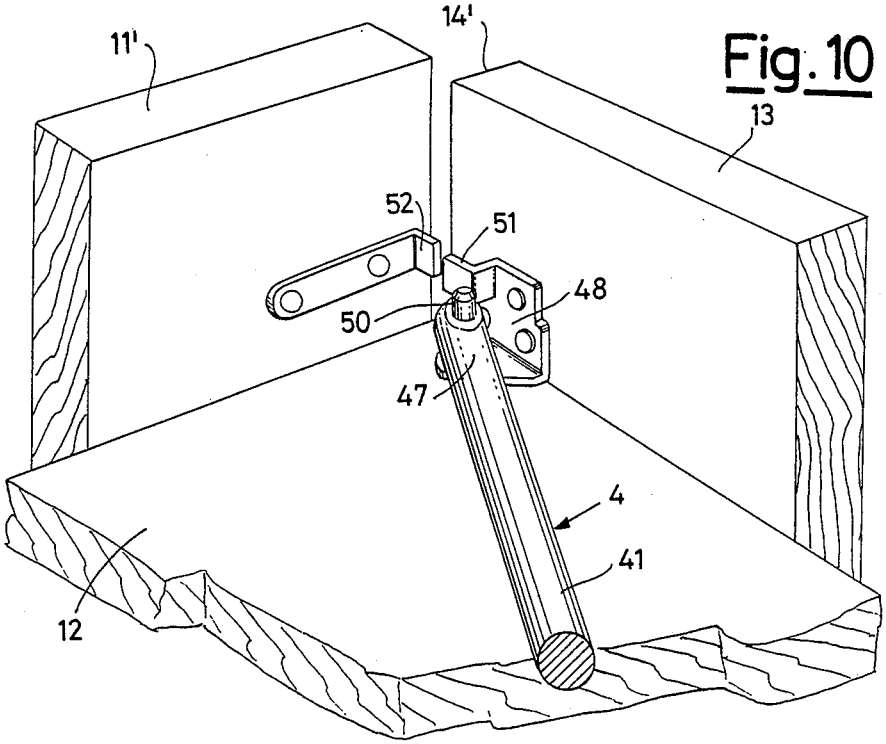

Lastly, FIGS. 9 and 10 represent, enlarged and in perspective, the connection device 51 and 52 between the door and the cabinet's fixed frame when the system according to the present invention is in the positions illustrated in FIGS. 2 and 3, respectively. It can thus be seen that the bracket 51 is integral with a support 48 fastened to the door 13 by screws or other suitable fastening means; said support 48 is also equipped with a pin 50 on which the extremity 47 of the rigid bar 41 is mounted in a rotatable way. In turn, the small plate 52 is the projection of a bracket fastened to the second vertical upright 11' of the fixed frame by screws or other suitable fastening means.

As already indicated above, many construction details may be modified without departing from the solution idea according to the present invention. For example, the assembly of the branch 25 of the arm 2 on the door may be accomplished, instead of with the rotatable extremity 21', by equipping the extremity of the arm 25 with a hinge and fastening a suitable device equipped with its female counterpart to the door 13.

The embodiments of the invention in which an exclusive property or privilege is claimed are defined as follows:

1. A system for moving a door of a cabinet from a closed to an open position, said cabinet comprising at least one door and one fixed frame comprised of at least one first and one second vertical upright as well as by at least one upper and one lower horizontal shelf, in which said door can be moved in relation to said fixed frame so that the vertical edge of the door next to said first vertical upright when said door is open will then be next to said second vertical upright when said door is closed, said door being moreover connected to said fixed frame by means of two elbow-shaped horizontal arms, each of which is comprised of two branches, by an elbow and by two extremities rotatable round respective pivots, and being the first extremity of one and the other elbow-shaped horizontal arms mounted rotatably on the upper and lower part, respectively, of said fixed frame while the said extremity of one and the other elbow-shaped horizontal arms is mounted rotatably on said door on an upper and a lower point, respectively, arranged on the vertical line which passes through the center of gravity of said door, characterized in the in each elbow-shaped horizontal arm the second branch, which lies between said second extremity and the elbow, is longer than the first branch, which lies between said elbow and said first extremity, that the length of said first branch of each elbow-shaped horizontal arm is equal to or greater than the distance between the pivot on which rotates said first extremity of each elbow-shaped horizontal arm and the closest point of the door in the closed position, and that said elbow-shaped horizontal arms co-operate with a guide which maintains the door substantially parallel to the fixed frame;

wherein said guide comprises a housing and a rigid bar, a first extremity of which is rotatably connected of the door while the other extremity is connected to said housing by means of a first pin which is integral with said rigid bar and by a second pin which is integral with said housing; wherein said housing has a slot in which said first pin is forced to move for determining the displacement of said rigid bar and of the door in relation to said second pin; wherein the extremity of said rigid bar which is connected to said housing has a slot and is mounted in a rotatable and slidable way in relation to said second pin; wherein a compressed spring is mounted between said first and said second pin; wherein said first extremity of said rigid bar is rotatably connected to a pin which is integral with a support fastened to the door; and wherein said support is integral with a bracket which is superimposed on a small plate fastened to the second vertical upright of the fixed frame thus causing the connection of said door with said fixed frame.

2. System according to claim 1, characterized in that said first rotatable extremity of said elbow-shaped horizontal arms is fastened to the upper and lower extremity, respectively, of said first vertical upright.

3. System according to claim 1, characterized in that said first rotatable extremity of said elbow-shaped horizontal arms is fastened above said upper horizontal shelf and below said lower horizontal shelf, respectively, next to said first vertical upright.

4. System according to claim 1, characterized in that said elbow of the horizontal arms is 90°.

5. System according to claim 1, characterized in that the ratio between the length of said second branch and the distance from said pivot of said second rotatable extremity of each horizontal arm to the edge of said door which is next to said second vertical upright in the closed position, is equal to or greater than 0.7.

* * * * *